US007726753B2

(12) United States Patent
Bassi

(10) Patent No.: US 7,726,753 B2
(45) Date of Patent: Jun. 1, 2010

(54) DRAWER CONTAINER DEVICE FOR AN ELECTRIC HOUSEHOLD APPLIANCE, IN PARTICULAR FOR THE FRESH FOOD COMPARTMENT OF A REFRIGERATOR OR FREEZER

(75) Inventor: Alberto Bassi, Turin (IT)

(73) Assignee: ITW Industrial Components S.r.L., Milan (IT)

( * ) Notice: Subject to any disclaimer, the term of this patent is extended or adjusted under 35 U.S.C. 154(b) by 60 days.

(21) Appl. No.: 11/358,150

(22) Filed: Feb. 22, 2006

(65) Prior Publication Data

US 2006/0186774 A1 Aug. 24, 2006

(30) Foreign Application Priority Data

Feb. 22, 2005 (IT) ..... TO2005A0104

(51) Int. Cl.
*A47B 81/00* (2006.01)

(52) U.S. Cl. ..... 312/272; 312/404; 312/408; 108/107

(58) Field of Classification Search ..... 312/402, 312/404, 330.1, 306; 220/8, 4.03; 206/557, 206/561, 564
See application file for complete search history.

(56) References Cited

U.S. PATENT DOCUMENTS

| | | | | |
|---|---|---|---|---|
| 2,730,423 | A * | 1/1956 | Mock | 312/334.22 |
| 4,275,940 | A * | 6/1981 | Draper | 312/209 |
| 5,037,163 | A * | 8/1991 | Hatcher | 312/323 |
| 5,483,902 | A * | 1/1996 | Grosch | 108/143 |
| 5,642,924 | A * | 7/1997 | Wohlrab et al. | 312/408 |

(Continued)

FOREIGN PATENT DOCUMENTS

| | | |
|---|---|---|
| EP | 1152201 A1 | 11/2001 |

(Continued)

OTHER PUBLICATIONS

European Search Report from European Patent Office completed May 3, 2006.

*Primary Examiner*—Janet M Wilkens
*Assistant Examiner*—Matthew W Ing
(74) *Attorney, Agent, or Firm*—Lowe Hauptman Ham & Berner LLP

(57) ABSTRACT

A drawer container device that can be inserted in a refrigerated cell to define a separate compartment, including at least a shelf provided with mating elements with the respective side walls of the refrigerated cell in a first position such as to define, immediately below the shelf, a first predetermined volume and at least one cup-shaped drawer delimited by at least one side wall placed transversely to the shelf and located in a position beneath the shelf with its concavity facing the latter, the shelf being selectively moveable between the first position and a second position located at a different height from the first and in which the shelf delimits a second predetermined volume beneath itself; the side wall of the drawer being defined by a pair of adjacent elements sliding relative to each other and placed parallel to and at least partially facing each other; regulating elements of the pin-and-groove type being interposed between the relatively sliding elements to selectively position them such that the side wall substantially occupies the entire height of the first and second predetermined volumes; in this way, the volume of the compartment can be varied by simply lifting the side wall of the drawer and the above shelf.

23 Claims, 4 Drawing Sheets

U.S. PATENT DOCUMENTS

| | | | | |
|---|---|---|---|---|
| 5,715,962 | A * | 2/1998 | McDonnell | 220/4.03 |
| 6,164,218 | A * | 12/2000 | Donalson | 108/144.11 |
| 6,908,004 | B2 * | 6/2005 | Barr | 220/4.26 |
| 2004/0119297 | A1 * | 6/2004 | Bella et al. | 292/300 |
| 2004/0183417 | A1 * | 9/2004 | Ahmed et al. | 312/408 |

FOREIGN PATENT DOCUMENTS

| | | | |
|---|---|---|---|
| EP | 1460360 | A2 | 9/2004 |
| EP | 1460360 | A3 | 1/2005 |
| JP | 2001050647 | A | 2/2001 |
| JP | 2001050648 | A | 2/2001 |

* cited by examiner

DRAWER CONTAINER DEVICE FOR AN ELECTRIC HOUSEHOLD APPLIANCE, IN PARTICULAR FOR THE FRESH FOOD COMPARTMENT OF A REFRIGERATOR OR FREEZER

RELATED APPLICATIONS

The present application is based on, and claims priority from, Italian Application Number TO2005A 000104, filed Feb. 22, 2005, the disclosure of which is hereby incorporated by reference herein in its entirety.

FIELD OF THE INVENTION

This invention relates to a drawer container device for an electric household appliance, in particular for the fresh food compartment (in which fruit and vegetables are normally conserved) of a refrigerator or a freezer, which can be adapted to the amount of food to be conserved.

BACKGROUND OF THE INVENTION

It is known that in electric household appliances equipped with a refrigerated cell, such as refrigerators and freezers, the food to be conserved is normally placed on a number of shelves arranged at different heights inside the refrigerated cell. Some foods, especially fresh foods such as fruit and vegetables, or certain types of frozen food, are instead conserved in special compartments, usually equipped with extractable drawers. In order to be able to adjust the height position of the shelves, the refrigerated cell of a refrigerator (FIG. 1) is equipped, on the opposite side walls, with a number of support guides T for the shelves P, usually of a greater number than the available shelves P; in this way, the user can selectively position the shelves P at different heights, according to the volume occupied by the food to be conserved. Fresh foods are instead placed in a compartment C defined by an extractable drawer arranged to occupy the lower part of the refrigerated cell and a shelf P1 placed in a fixed position, immediately above the drawer. The compartment C therefore has fixed volume and shape.

When the user must put away a large amount of fresh food, occupying a greater volume than that of the compartment C, part of this food must therefore be stored on the shelves P, outside of the compartment C, with considerable drawbacks.

In the first place, fresh food stored outside of the compartment C can more easily deteriorate. Furthermore, its rational placing on the shelves P (often consisting of simple grills) is not easy and the food often moves following repeated accesses to the refrigerated cell or the removal and addition of other food. In consequence, fresh food kept outside of the compartment C is often left inside bags made of PP or PE, also to protect it from any moisture that may run down the walls of the refrigerated cell, as a result of repeated automatic defrosting for example, ultimately further deteriorating its conservation.

SUMMARY OF THE INVENTION

The object of this invention is that of obviating the described drawbacks by providing a drawer container device for an electric household appliance, in particular for the fresh food compartment of a refrigerator, in which the dimensions and especially the volume of the drawer can be varied in a rapid and simple manner by the user.

In particular, a further object of the invention is that of avoiding the need to free the shelf immediately above the compartment of any food placed on it, and to extract and reinsert both the shelf and the drawer delimiting the compartment in another position.

Finally, an object of the invention is that of embodying a device of the aforesaid type that is reliable, of reduced bulk, with low production costs and easy to assemble, even for already existing electric household appliances.

This invention therefore relates to a drawer container device for an electric household appliance, such as a refrigerator or freezer, as defined in the attached claims.

In particular, according to the invention, the container device is advantageously applicable to the fresh food compartment of a refrigerator and comprises at least one shelf equipped with means of mating to the respective side walls of the refrigerated cell in at least a first and a second position, placed at different heights and such as to define inside the refrigerated cell, in a position immediately below said shelf, respectively, a first and a second predetermined volume that are different from each other, and at least one cup-shaped drawer delimited by at least one side wall placed transversely to the shelf, said drawer being placed under said shelf with its concavity facing towards the shelf. Said at least one side wall of the drawer comprises at least one pair of adjacent elements, sliding relatively to each other and placed parallel to and at least partially facing each other; whilst first regulating means of the pin-and-groove type are interposed between said at least one pair of relatively sliding elements to move them selectively between a first and a second position in which said side wall of the drawer substantially occupies the entire height of, respectively, said first and second predetermined volumes. The first regulating means are also of the type suited to permit the passage between said first and second position, and vice versa, under the effect of a simple upward push exerted by a user on said at least one side wall of the drawer.

Similarly, the means of mating between said at least one shelf and the side walls of the refrigerated cell preferably comprise second regulating means of the pin-and-groove type, which are interposed between the side walls of the refrigerated cell and the respective opposite lateral sides of the shelf to move the shelf selectively between the first and the second position in the refrigerated cell, said second regulating means being of the type suited to permit the passage between said first and second position, and vice versa, under the effect of an upward push exerted by a user on said shelf.

In this way, the shelf upwardly delimiting the compartment can be moved to two different heights without the need to remove any food that might be laying on it; similarly, with the same or a successive movement, the user can produce a similar variation in the height of the side walls of the drawer, consequently changing the dimensions of the compartment between the cited first and second volumes as desired. These volumes, in the case of the fresh food compartment of a refrigerator for example, can be chosen such that the drawer is able to hold a full week's shopping and can be subsequently reduced in volume as the fresh food is consumed or cooked, thus freeing space in the refrigerated cell for adding new food or cooked fresh food that, after cooking, must no longer be conserved in the compartment, but on a suitable shelf of the refrigerated cell.

BRIEF DESCRIPTION OF THE DRAWINGS

Further characteristics and advantages of this invention will appear clear from the description that follows of a non-limitative embodiment thereof, made with reference to the figures of the attached drawings, in which.

DETAILED DESCRIPTION OF THE INVENTION

Figure 1:
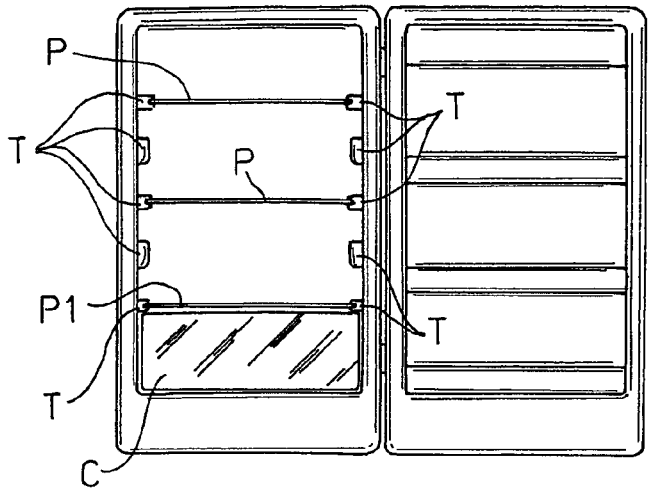
FIG. 1 schematically illustrates a refrigerator equipped with height-adjustable shelves of the traditional type and a fixed-volume fresh food compartment.

With reference to FIGS. 2 to 7, reference 1 indicates, as a whole, an electric household appliance equipped with a refrigerated cell 2 inside which a separate compartment 3 is provided, defined by a drawer 4 that can be inserted and extracted by frontally sliding in/out of the cell 2 and by an immediately superior shelf 5 for foodstuffs (not shown) that can be inserted in the refrigerated cell 2 integrally with the opposite side walls 7 of the refrigerated cell 2 itself. The shelf 5 is the lowest shelf present in the cell 2; the other shelves above are not illustrated for simplicity.

In the non-limitative embodiment described herein, the compartment 3 is a fresh food compartment of a refrigerator 1, but what will be said holds true for any drawer-type compartment for electric household appliances, such as the "special food" compartment of a freezer for example.

Figure 3:
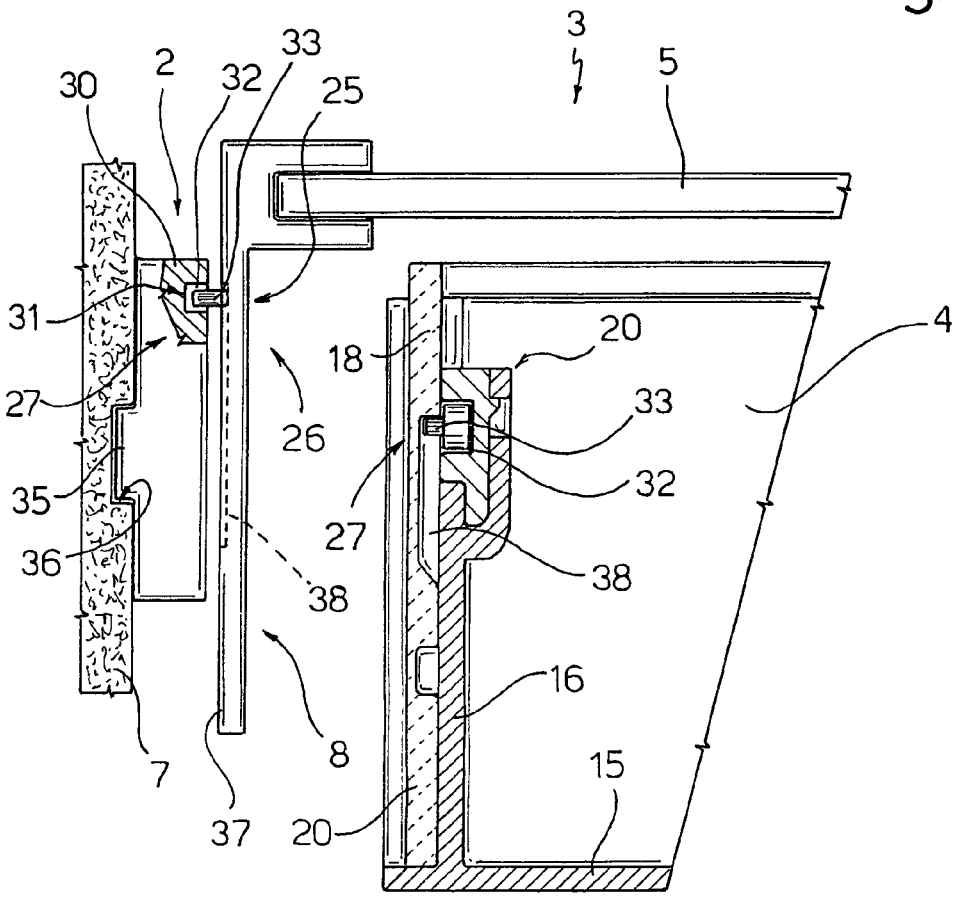
FIGS. 3 and 4 illustrate an enlarged-scale orthogonal cross-section view along a trace plane III-III of the drawer of the compartment in FIG. 1, shown mated to the upper shelf, in two different usage configurations.
Figure 4:
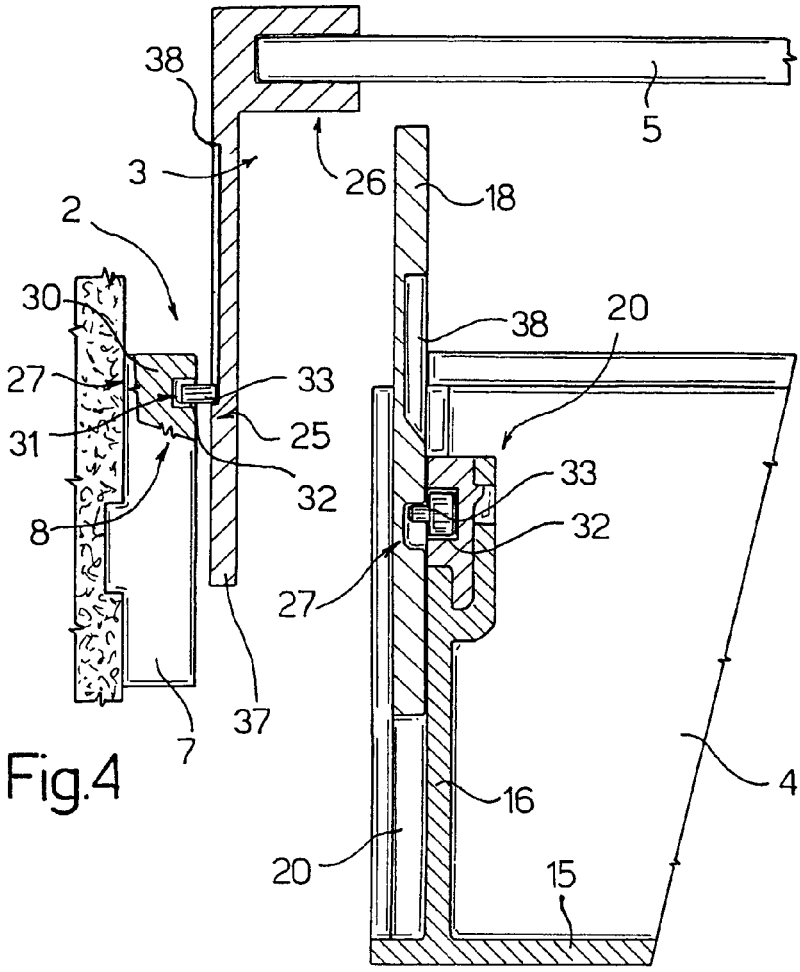
Figure 5:
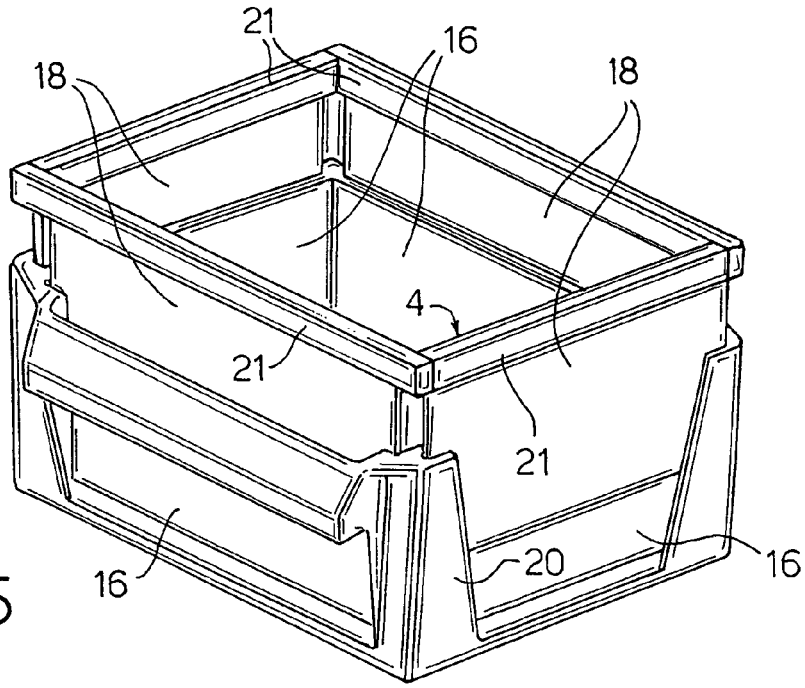
FIG. 5 illustrates a perspective of the drawer in FIG. 2 in a second usage configuration, corresponding to that of FIG. 4, FIGS. 6 and 7 illustrate enlarged-scale perspective views, with parts removed, of the same constructional detail of the device of this invention in the usage configurations of FIGS. 3 and 4 respectively.

In accordance with the invention, the shelf 5 is fitted with selectively mating means, indicated as a whole by reference 8, with the respective walls 7 in at least a first and a second position (FIGS. 3 and 4), arranged at different heights and such as to define inside the refrigerated cell 2, in a position immediately below the shelf 5, respectively, a first and a second predetermined volume, different from each other; in particular, the second volume delimited by the compartment 3 in the configuration in FIG. 4 is larger than the volume delimited by the compartment 3 in the configuration in FIG. 3, as the shelf 5 is located, respectively, in a higher (FIG. 4) and a lower position (FIG. 3).

In combination with the aforesaid characteristic, not present in traditional electric household appliances, where the lowest shelf 5 of the cell 2 is a fixed shelf, the drawer 4, which has a cup-like shape, has variable height dimensions, as will be seen in detail in the following.

In particular, the drawer 4 is delimited by at least one front side wall 10, and further, by three other side walls, respectively a rear wall 12 positioned facing wall 10, and a right wall 13 and left wall 14, positioned facing each other and perpendicular to walls 10 and 12; in use, all four walls 10, 12, 13 and 14 are positioned transversely to the shelf 5, which is immediately above the drawer 4, which in use is in fact mounted to slide parallel to the walls 7 below the shelf 5, with its own concavity facing towards the shelf 5 itself. Finally, the drawer 4 is provided with a bottom wall 15, parallel to the shelf 5 and possibly with a handle 11, positioned on the front side wall 10, for example.

At least this front side wall 10 of the drawer 4 (each of the four walls 10, 12, 13 and 14 in the case illustrated herein) comprises at least one pair of wall panel elements 16 and 18, adjacent and sliding relatively to each other, arranged parallel to each other and, in use, at least partially facing each other. Then, in accordance with the invention, first regulating means of the pin-and-groove type, indicated as a whole by reference 20, are inserted between wall elements 16 and 18 of at least one of the walls 10, 12, 13 and 14 or, preferably, of at least one pair of facing walls, in the case in hand between elements 16 and 18 of the right side wall 13 and left side wall 14, for selectively moving them between a first (FIG. 3) and a second position (FIG. 4), in which each respective side wall of the drawer 4 substantially occupies the entire height of, respectively, the cited first and second predetermined volumes.

In the illustrated non-limitative example, the four side walls 10, 12, 13 and 14 are integral with each other; in particular, wall elements 16 and 18 of each one of them are telescopically mounted on a frame support 20, integral with the bottom wall 15. The wall element 16 of each side wall 10, 12, 13 and 14 is positioned on the inner side of the drawer 4 and fixed to the support 20, while the corresponding wall element 18 of each side wall of the drawer 4 is positioned on the outer side of the same drawer 4 and is able to slide vertically on the support 20.

Figure 8:
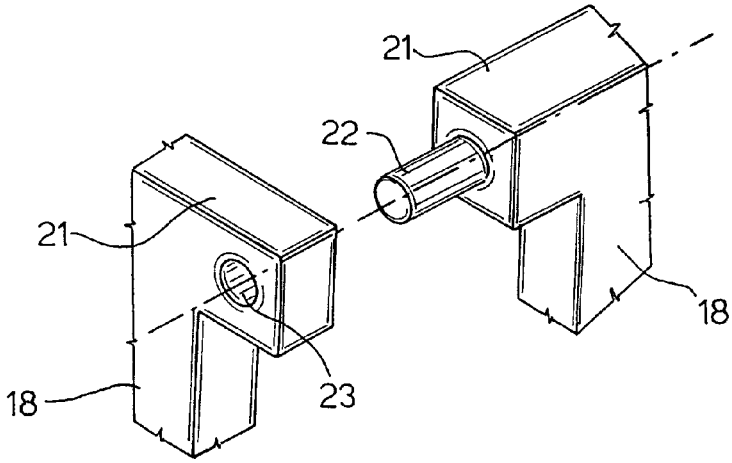
FIG. 8 illustrates a further detail, in enlarged scale, of the drawer of the device of this invention.

Furthermore (FIG. 8), the outer wall elements 18 carried to slide vertically by the frame support 20, are provided, each, with a respective enlarged top edge 21, and are integrally connected together, at the respective ends adjacent to their top edges, for example, via engagement elements such as pins 22 of each element that can be engaged in corresponding grooves or holes 23 of the adjacent element.

According to the invention, the regulating means 20 are of the type suited to permit the passage of wall elements 16 and 18 between the cited first and second position, and vice versa, under the effect of a simple upward push exerted by a user on said at least one of the side walls of the drawer 4, for example, via the handle 11 (in the case where it is obtained integrally with the wall 10) or the edge 21, in other words are of the so-called "push-push" type.

Furthermore, in accordance with a non-minor aspect of the invention, mating means 8 between the shelf 5 and the side walls 7 of the refrigerated cell 2 also comprise their own regulating means of the pin-and-groove type, indicated as a whole by reference 25 (FIGS. 3 and 4), which are interposed between the side walls 7 of the refrigerated cell 2 and the respective opposite lateral sides 26 of the shelf 5 for selectively moving the shelf 5 inside the refrigerated cell 2 between the cited first and second positions. In accordance with the invention, these second regulating means 25 of the pin-and-groove type, are also of the type suited to permit the passage of the shelf 5 between the first and second position, and vice versa, under the effect of a simple, direct or indirect, upward push exerted by a user on said shelf 5, for example, by acting on a front edge of the shelf 5.

In particular, both of the regulating means 20 and 25 are of the type comprising identical pin-and-groove type connecting means 27 (illustrated in detail in FIGS. 6 and 7 with regard to just regulating means 20) having at least two blocking positions, positioned at different heights corresponding respectively to the first and second position associated with the pair of relatively sliding wall elements 16 and 18 of the drawer 4, and the shelf 5.

In addition, the pin-and-groove type connecting means 27 having at least two blocking positions, which have been selected in accordance with the invention, do not need elastic means for their operation.

With regards to the regulating means 25, these are of the same type described in the applicant's co-pending Italian patent application no. TO2004A00087 filed on 17 Feb. 2004; in the case in hand, the mating means 8 comprise at least a pair of opposite first supports 30 in use mounted integrally with the side walls 7 of the refrigerated cell 2 and provided with respective first faces facing in use shelf 5 and fitted with first coupling elements 31 of cited connecting means 27 of the pin-and-groove type.

The coupling elements 31 include longitudinal grooves 32 that extend parallel to the lateral sides of the shelf 5 for a predetermined length, located parallel to the shelf 5 itself, each of which is engaged by a sliding pin 33 that projects outside of the corresponding groove 32.

In accordance with a first possible embodiment, as illustrated in FIG. 3, the supports 30 have second faces opposite to the first ones and facing towards the respective side walls 7 of the refrigerated cell 2, which are provided with an element 35 joined by slide-in mating with the respective support guide 36 obtained in one piece with the side walls 7; vice versa, a second possible embodiment, as illustrated for convenience in FIG. 4, provides for supports 30 that are directly obtained in one piece with the walls 7.

In both embodiments, however, the regulating means 25 also comprise at least a pair of second supports 37, each associated with a respective lateral side 26 of the shelf 5, the supports 37 carrying second coupling elements 38 of the connecting means 27 of the pin-and-groove complementary to said first coupling elements 31 and illustrated only as a broken line for simplicity. In the case in hand, the supports 37 are formed by respective flat plates positioned perpendicularly to the shelf 5 and projecting downwards with respect to a plane on which the shelf 5 itself lies.

Figure 6:
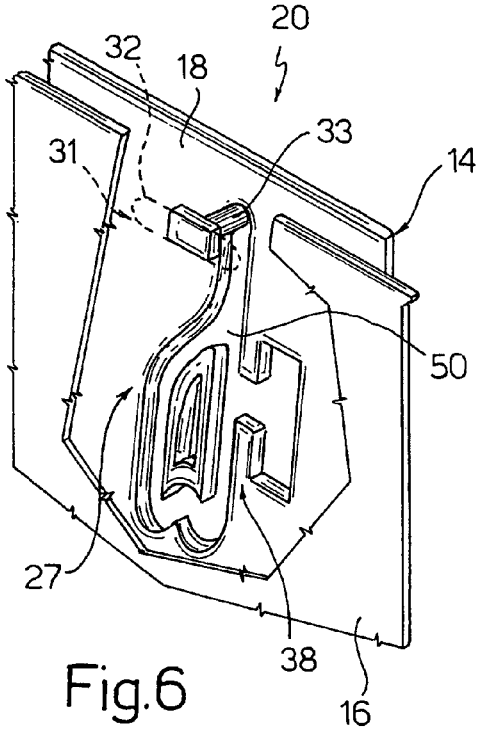
Figure 7:
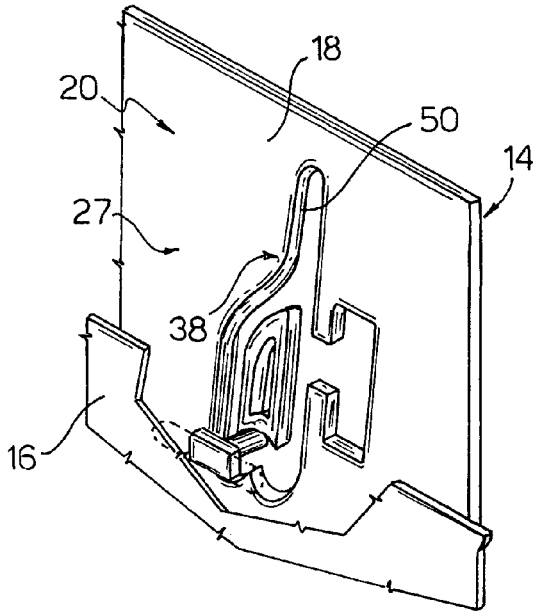

The pin-and-groove type connecting means 27, identical for the regulating means 20 and 25, are illustrated in greater detail in FIGS. 6 and 7 with regards to just the means 27 associated with regulating means 20; it being clearly understood that what is illustrated and described concerning the connecting means 27 of regulating means 20 is also applicable, by translation, to the corresponding connecting means 27 of regulating means 25, already described as a whole earlier on.

According to that illustrated in FIGS. 6 and 7, the connecting means 27 of regulating means 20 are interposed between the pairs of relatively sliding elements 16 and 18 of the side walls 13 and 14, and comprise first coupling elements 31 (partially illustrated as a broken line) and second coupling elements 38 that are complementary to each other (as in the already described case of regulating means 25), but which, in this case, are integrally carried, respectively, by element 16 (in particular by the illustrated portion of element 16 removed to allow the underlying coupling elements 38 to be seen) and by element 18 of each wall 13 and 14 (in FIGS. 6 and 7, for simplicity only wall 14, seen from inside the drawer 4, is illustrated).

In particular, wall element 16 located on the inner side of the drawer and fixed to the support, carries the coupling means 31, in this case also consisting of a groove 32 obtained in one piece with wall element 16 on the side facing wall element 18, and a sliding pin 33 engaged in the groove 32 and projecting from it, perpendicular to wall element 16 and towards element 18. The latter, located on the outer side of the drawer and able to slide vertically on the support 20 is obtained in one piece, on the side facing element 16, with the second coupling means 38 (only schematically illustrated in FIGS. 3 and 4), which comprise respective desmodromic tracks 50 shaped like an upside-down Y, each of which is engaged in a sliding manner by the respective pin 33, which offers two different positions of stable coupling, respectively upper, illustrated in FIG. 6, and lower, illustrated in FIG. 7.

Figure 2:
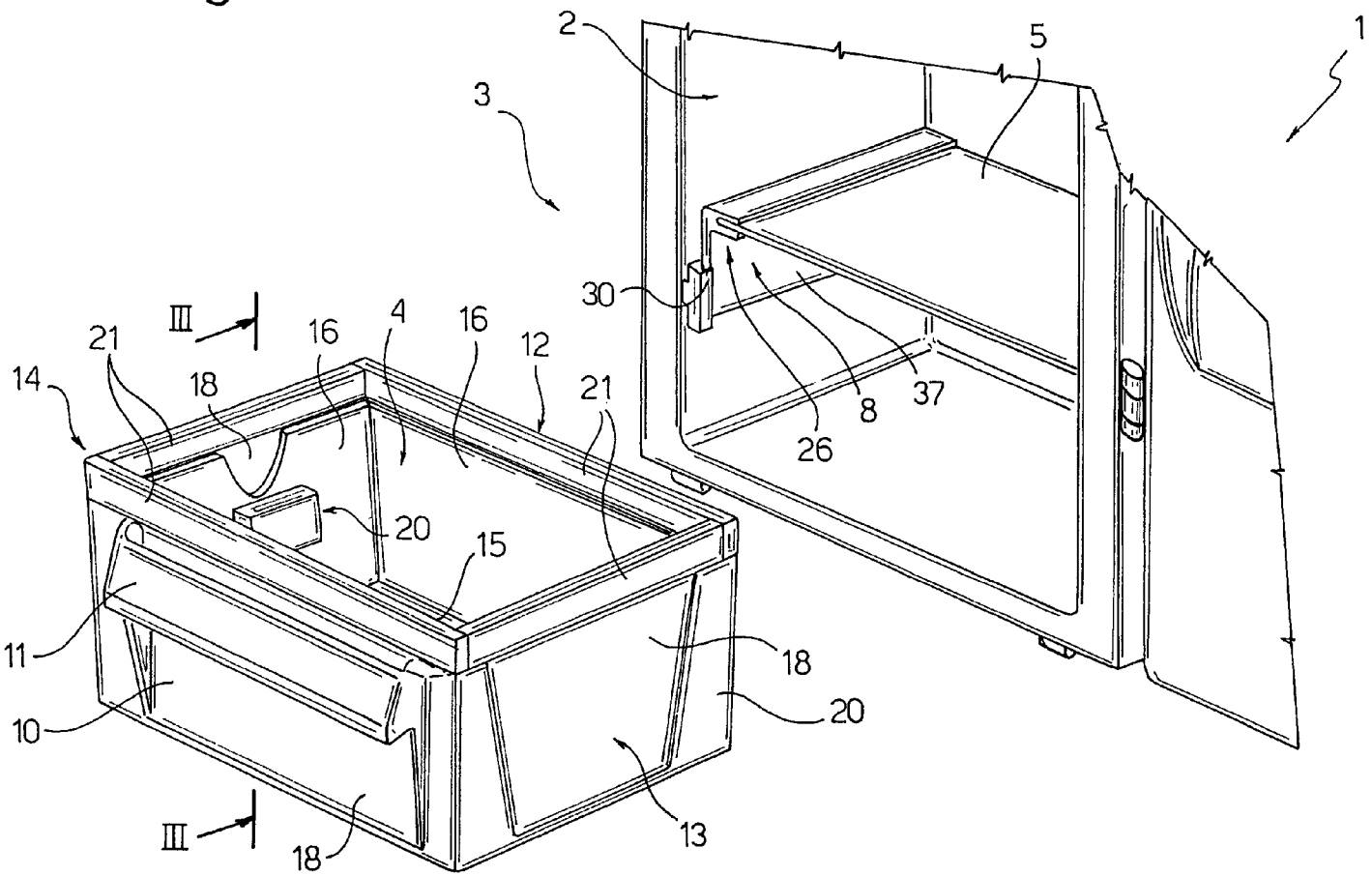
FIG. 2 illustrates a schematic view with a front three-quarters perspective of the lower part of a refrigerator provided with a variable-volume compartment embodied according to the invention, including a drawer and an upper shelf, both illustrated in a first possible usage configuration.

The drawer 4 and the shelf 5 are normally set in the configuration shown in FIG. 2, with the respective connecting means 27 in the configuration shown in FIG. 6. Following an upward push exerted by the user on the shelf 5 and, for example, on the front wall 10 (via the edge 21), the pin 33, which is free to move within the groove 32, which has an adequate length for this purpose, can slide along the two branches of the Y-shaped track 50 to reach the two different coupling positions that it defines, illustrated in FIGS. 6 and 7, in correspondence to which the track 50 has special recesses into which the pin 33 "snaps", remaining blocked and supporting the shelf 5 and wall elements 18 in the position that has been reached. Thus, in consequence of said upward push, the drawer 4 takes on the configuration of greater volume shown in FIG. 5, while the shelf 5 will also adapt, moving to a higher position (FIG. 4), to make space for the drawer 4. A further upward push will return the drawer 4 and shelf 5 to the initial configuration (FIGS. 2 and 3).

The invention claimed is:

1. A drawer container device for defining a plurality of predetermined volumes in an appliance, said device comprising:

at least a pair of opposite side walls attached to a base thereof, wherein each of said side walls comprises:

a support wall element;

an inner wall element supported on the base and disposed parallel to the support wall element;

an outer wall element, slidably moveable relative to the inner wall element, the support wall element and to the base, said outer wall element is sandwiched between said inner and support wall elements, said inner, outer and support wall elements are transversely located relative to the base;

a first adjustment element set only between and connecting respective opposite lateral sides of the outer wall element and the inner wall element for selectively and vertically displacing the outer wall element between at least one first position and one second position relative to the inner wall element, wherein said first adjustment element comprises a pin disposed on the lateral side of any one of the inner wall element and the outer wall element, said lateral side having a longitudinal groove for moveably retaining the pin therein; and a closed retaining groove provided on the lateral side of the other of the inner wall element and the outer wall element, said closed retaining groove having at least two blocking positions, arranged at different heights corresponding to said first and second positions, respectively, and engaged with a portion of the pin extending from the longitudinal groove to moveably retain the pin in said closed retaining groove, wherein while selectively displacing the outer wall element between the first and second positions, said pin moves relative to both said grooves.

2. The device according to claim 1, wherein the inner wall element and the support wall element are integral with the base.

3. The device according to claim 1, wherein the outer wall elements of the side walls are each provided with a respective enlarged top edge, and are integrally connected with each other at respective adjacent ends of the side walls via engagement elements located in the respective adjacent ends of the side walls.

4. An appliance, comprising:

a cell having on side walls thereof supporting guides arranged at predetermined distances from a bottom of the cell;

at least one shelf;

at least one drawer container having at least a pair of opposite side walls attached to a base thereof;

at least a first device for positioning said shelf at different heights within said cell of said appliance; and at least a second device for positioning said side walls of the drawer container at different heights within said cell of said appliance, wherein said first device comprises:

a first coupling element having opposite first side and second side, said first side slidably engaged with one of the supporting guides in the cell;

a first adjusting element coupled to the second side of said first coupling element while being moveable vertically with respect to the first coupling element, said first adjusting element holding a respective one of lateral sides of the shelf; and at least a first pin which is slidably mounted inside an elongated slot located on the second side of the first coupling element and extends outward from said slot;

wherein said first adjusting element has a first retaining groove having a plurality of blocking structures corresponding to a plurality of relative vertical positions between the first adjusting element and the first coupling element;

each said side wall of the drawer container comprises:

a support wall element, an inner wall element supported on the base and disposed parallel to the support wall element, an outer wall element slidably moveable relative to the inner wall element, the support wall element and to the base, said inner wall element is adjacent to said outer wall element and said outer, inner and support wall elements are transversely located relative to the base; and said second device comprises:

a second adjusting element set only between and connecting respective opposite lateral sides of the outer wall element and the inner wall element for selectively and vertically displacing the outer wall element between at least one first position and one second position relative to the inner wall element, wherein said second adjusting element comprises a second pin disposed on the lateral side of any one of the inner wall element and the outer wall element, said lateral side having a longitudinal groove for moveably retaining the second pin therein; and a second retaining groove provided on the lateral side of the other of the inner wall element and the outer wall element, said retaining groove having at least two blocking positions, arranged at different heights corresponding to said first and second positions, respectively, and engaged with a portion of the second pin extending from the longitudinal groove to moveably retain the second pin in said second retaining groove, wherein while selectively displacing the outer wall element between the first and second positions, said second pin moves relative to both said longitudinal groove and said second retaining groove; and said inner and outer wall elements are always connected by said second pin.

5. The appliance according to claim 4, wherein said first side of said first coupling element includes a horizontally elongated projection.

6. The appliance according to claim 4, wherein the slot is elongated horizontally.

7. The appliance according to claim 4, wherein said adjusting element of the first device has two parallel projections defining a fork slidably retaining the respective lateral side of the shelf.

8. The appliance according to claim 4, wherein said first pin, of said first device, extends from the slot into said first retaining groove and is moveable, when an upward or downward force is exerted on the first adjusting element, in a predefined path inside the first retaining groove until said first pin is retained by one of the blocking structures, thereby displacing the first adjusting element among the relative vertical positions of the first adjusting element and the first coupling element and thereby facilitating vertical movement of the shelf to a plurality of heights within the cell without having to move the first coupling element to the other supporting guides.

9. The appliance according to claim 4, wherein the inner wall element and the support wall element are integral with the base.

10. The device according to claim 4, wherein the outer wall elements of the side walls are each provided with a respective enlarged top edge, and are integrally connected with each other at respective adjacent ends of the side walls via engagement elements located in the respective adjacent ends of the side walls.

11. The appliance according to claim 4, wherein the drawer is located below the shelf.

12. The device of claim 1, wherein the support wall element, the outer wall element and the inner wall element are plates extending along a breadth of the side wall.

13. The appliance according to claim 4, wherein the support wall element, the outer wall element and the inner wall element are plates extending along a breadth of the side wall of the drawer container.

14. The device according to claim 1, wherein the longitudinal groove extends transversely to a displacement direction of the outer wall element between the first and second positions.

15. The appliance according to claim 4, wherein the longitudinal groove extends perpendicularly to a displacement direction of the outer wall element between the first and second positions.

16. The device according to claim 14, wherein the longitudinal groove defines at least two parallel straight edges.

17. The appliance according to claim 15, wherein the longitudinal groove is straight.

18. The device according to claim 1, wherein the pin is non-accessible from the outside of the outer wall element and the inner wall element.

19. The appliance according to claim 4, wherein said second pin is entirely confined between the outer wall element and the inner wall element.

20. The device according to claim 1, wherein, when said pin is retained at any one of the blocking positions, said pin is only dislodgeable from said blocking position by an upward force exerted by a user on the first adjustment element.

21. The appliance according to claim 4, wherein, when said second pin is retained at any one of the blocking positions, said second pin is only dislodgeable from said blocking position by an upward force exerted by a user on the shelf.

22. The appliance according to claim 1, wherein said first adjusting element further comprises a T-shaped slot joined with the closed retaining groove.

23. The appliance according to claim 4, wherein said first adjusting element further comprises a T-shaped slot joined with the retaining groove which is a closed groove.

* * * * *